US009447482B2

(12) United States Patent
Kim et al.

(10) Patent No.: US 9,447,482 B2
(45) Date of Patent: Sep. 20, 2016

(54) MAGNESIUM-BASED ALLOY PRODUCED USING A SILICON COMPOUND AND METHOD FOR PRODUCING SAME

(75) Inventors: Shae K. Kim, Seoul (KR); Young Ok Yoon, Incheon (KR); Jin Kyu Lee, Incheon (KR); Jung Ho Seo, Seoul (KR); Hyun Kyu Im, Incheon (KR)

(73) Assignee: KOREA INSTITUTE OF INDUSTRIAL TECHNOLOGY, Chungcheongnam-do (KR)

( * ) Notice: Subject to any disclaimer, the term of this patent is extended or adjusted under 35 U.S.C. 154(b) by 416 days.

(21) Appl. No.: 14/117,574

(22) PCT Filed: May 18, 2012

(86) PCT No.: PCT/KR2012/003964

§ 371 (c)(1), (2), (4) Date: Nov. 13, 2013

(87) PCT Pub. No.: WO2012/161484

PCT Pub. Date: Nov. 29, 2012

(65) Prior Publication Data

US 2014/0202284 A1 Jul. 24, 2014

(30) Foreign Application Priority Data

May 20, 2011 (KR) ..... 10-2011-0048099

(51) Int. Cl.

| | |
|---|---|
| ***C22C 23/00*** | (2006.01) |
| ***C22C 1/02*** | (2006.01) |
| ***C22B 26/22*** | (2006.01) |
| ***B22D 21/04*** | (2006.01) |
| ***C22B 9/10*** | (2006.01) |

(52) U.S. Cl.

CPC ..... *C22B 26/22* (2013.01); *B22D 21/04* (2013.01); *C22B 9/10* (2013.01); *C22C 23/00* (2013.01)

(58) Field of Classification Search

CPC ..... C22C 1/02; C22C 23/00; C22B 26/22; B22D 21/04

USPC ..... 75/10.67, 604; 430/402

See application file for complete search history.

(56) References Cited

U.S. PATENT DOCUMENTS 8,734,564 B2 * 5/2014 Kim ..... C22C 23/00 148/420

8,808,423 B2 * 8/2014 Kim ..... C22C 1/02 420/402

(Continued)

FOREIGN PATENT DOCUMENTS

JP 05-148564 6/1993

JP 08-041564 2/1996

(Continued)

OTHER PUBLICATIONS

English translation of the Written Opinion of the International Search Report mailed Nov. 23, 2012 for PCT/KR2012/003964; 6 pages.*

(Continued)

*Primary Examiner* — Helene Klemanski

(57) ABSTRACT

The present invention relates to a magnesium-based alloy, and to a method for producing same. The method comprises the steps of: melting a magnesium alloy into a liquid state; adding a silicon compound to said molten magnesium alloy; exhausting the silicon compound through a full reaction between said molten magnesium alloy and said added silicon compound such that the silicon compound does not substantially remain in the magnesium alloy; and exhausting the silicon produced as a result of said exhaustion in the precious step such that the silicon may not substantially remain in said magnesium alloy.

21 Claims, 10 Drawing Sheets

(56) References Cited

U.S. PATENT DOCUMENTS

| | | | | |
|---|---|---|---|---|
| 9,080,225 | B2 * | 7/2015 | Kim | C22C 1/02 |
| 9,085,815 | B2 * | 7/2015 | Kim | C22C 1/02 |
| 2014/0086790 | A1 * | 3/2014 | Kim | C22C 23/00 420/546 |
| 2014/0093420 | A1 * | 4/2014 | Kim | B22D 21/04 420/591 |
| 2014/0199205 | A1 * | 7/2014 | Kim | B22D 21/04 420/546 |

FOREIGN PATENT DOCUMENTS

| | | |
|---|---|---|
| JP | 2002-309322 | 10/2002 |
| JP | 2003-183747 | 7/2003 |
| WO | WO 2012/161459 A2 * | 11/2012 |
| WO | WO 2012/161461 A2 * | 11/2012 |
| WO | WO 2012/161463 A2 * | 11/2012 |

OTHER PUBLICATIONS

Y. Tsunekawa et al.; "Application of ultrasonic vibration to in situ MMC process by electromagnetic stirring"; Materials and Design, vol. 22, Issue 6, pp. 467-472; Sep. 2001.*

English translation of JP 05/148564; Jun. 1993; 3 pages.*

English translation of JP 08/041564; Feb. 1996; 4 pages.*

International Search Report mailed Nov. 23, 2012 for PCT/KR2012/003964.

Written Opinion of the International Search Report mailed Nov. 23, 2012 for PCT/KR2012/003964.

* cited by examiner

File Name = MgSi-3
File Comment =
Pos. Comment =
(Counts) Acc.V (kV) = 15 Beam Size (um) = -8 B.C. (uA) = 0.0556 S.C (uA) = 0.0412

* Ratio [Correction = ZAF1]

| No. | ELE. | Crystal | V.L.(A) | PKJ-BGI | STD(I) | I-Ratio | WT(%) | Nol(%) | ELE. |
|---|---|---|---|---|---|---|---|---|---|
| 1 | Mg Ka | RAP | 9.9300 | 9748.23 | 3180.35 | 3.0649 | 73.796 | 79.026 | Mg |
| 2 | Si Ka | PET | 7.1254 | 9749.23 | 995.00 | 0.5257 | 18.849 | 17.243 | Si |
| 3 | Ca Ka | PET | 3.3594 | 966.43 | 3507.03 | 0.2756 | 7.361 | 4.721 | Ca |
| TOTAL | | | | | | | 100.000 | | |

* Ratio [Correction = ZAF1]

| No. | ELE. | Crystal | V.L.(A) | PKU-BGI | STD(I) | I-Ratio | WT(%) | Nol(%) | ELE. |
|---|---|---|---|---|---|---|---|---|---|
| 1 | Mg Ka | RAP | 9.9300 | 9614.25 | 3180.95 | 2.0224 | 70.109 | 72.963 | Mg |
| 2 | Si Ka | PET | 7.1254 | 878.38 | 895.00 | 0.7557 | 26.711 | 24.056 | Si |
| 3 | Al Ka | PET | 8.3399 | 290.05 | 8729.77 | 0.0779 | 3.190 | 2.991 | Al |
| TOTAL | | | | | | | 100.000 | | |

MAGNESIUM-BASED ALLOY PRODUCED USING A SILICON COMPOUND AND METHOD FOR PRODUCING SAME

This application claims the priority of Korean Patent Application No. 10-2011-0048099, filed on May 20, 2011 in the KIPO (Korean Intellectual Property Office), the disclosure of which is incorporated herein entirely by reference. Further, this application is the National Stage application of International Application No. PCT/KR2012/003964, filed May 18, 2012, which designates the United States and was published in Korean. Each of these applications is hereby incorporated by reference in their entirety into the present application.

TECHNICAL FIELD

Aspects of the present invention relate to a magnesium-based alloy produced by directly adding a silicon compound to molten magnesium or magnesium alloy, instead of silicon, and a method for producing the same. More particularly, aspects of the present invention relate to a magnesium-based alloy, which is produced by adding a silicon compound to molten magnesium or magnesium alloy to cause a reduction reaction of the silicon compound to take place in the molten magnesium or magnesium alloy and making silicon generated by the reduction reaction into a compound in the molten magnesium or magnesium alloy.

Background Art

In general, magnesium or a magnesium alloy is a lightest metal among practically used metals and is expected as a lightweight material owing to excellent specific strength, specific rigidity. The magnesium alloy is generally produced by adding an alloy element, not a compound, to magnesium or a magnesium alloy.

DISCLOSURE OF THE INVENTION

Technical Problem

Aspects of the present invention provide a magnesium-based alloy produced using a new method by adding a silicon compound to molten magnesium or magnesium alloy, and a method for producing the same.

Other aspects of the present invention provide a magnesium-based alloy and a method for producing the same, which can reduce the production cost of the alloy using a silicon compound ($SiO_2$), which is relatively cheap, instead of silicon (Si) added to existing magnesium or magnesium alloy.

Aspects of the present invention further provide a magnesium-based alloy and a method for producing the same, which can maximize the effect of adding an alloy element by minimizing dissolution of Si by indirectly adding a silicon compound, instead of silicon (Si).

Aspects of the present invention further provide a magnesium-based alloy and a method for producing the same, which can enhance physical properties of magnesium alloy by increasing an amount of a silicon compound generated in magnesium or magnesium alloy.

Additional aspects and/or advantages of the invention will be set forth in part in the description which follows and, in part, will be obvious from the description, or may be learned by practice of the invention.

Technical Solution

In accordance with one aspect of the present invention, there is provided a method for producing a magnesium-based alloy, the method including melting a magnesium alloy into a liquid phase, adding a silicon compound to the molten magnesium or magnesium alloy, exhausting at least some of the silicon compound in the molten magnesium or magnesium alloy through a full reaction between the molten magnesium or magnesium alloy and the added silicon compound such that the silicon compound does not substantially remain in the magnesium alloy, and reacting at least some of the silicon produced as a result of the exhausting in the molten magnesium or magnesium alloy.

In accordance with another aspect of the present invention, there is provided a method for producing a magnesium-based alloy, the method including melting a magnesium or magnesium alloy into a liquid phase, adding a silicon compound to the molten magnesium or magnesium alloy, exhausting the silicon compound through a full reaction between the molten magnesium alloy and the added silicon compound such that the silicon compound does not substantially remain in the magnesium alloy, and reacting the silicon produced as a result of the exhausting such that the silicon compound does not substantially remain in the magnesium alloy.

The method may further include evenly spreading the added silicon compound on the molten magnesium or magnesium alloy such that the added silicon compound is not mixed into the molten magnesium or magnesium alloy.

Oxygen elements in the silicon compound may be removed in the form of oxygen gas or in the form of dross through a combination of magnesium elements in the molten magnesium or magnesium alloy and/or magnesium alloy elements.

The reaction between the molten magnesium or magnesium alloy and the added silicon compound may be promoted by agitating the molten magnesium or magnesium alloy.

The silicon produced as a result of the exhausting may not substantially remain by forming a compound with at least one of magnesium in the magnesium alloy and other alloy elements.

The silicon compound may be in a powder phase to promote a reaction between the silicon compound with the magnesium or magnesium alloy.

The silicon compound may be added to the molten magnesium or magnesium alloy in an amount enough to fully react with the molten magnesium or magnesium alloy to be completely exhausted such that the silicon compound does not substantially remain in the magnesium alloy.

The agitating may be performed by electromagnetically agitating the molten magnesium or magnesium alloy. Alternatively, the agitating may be performed by mechanically agitating the molten magnesium or magnesium alloy.

The agitating may be performed in a state in which a surface of the molten magnesium or magnesium alloy is exposed in the air. The produced compound may be $Mg_2Si$.

The silicon compound may have a grain size in a range of 0.1 to 200 μm. The silicon compound may be added in an amount of 0.001 wt % to 30 wt %.

In accordance with another aspect of the present invention, there is provided a method for producing a magnesium-based alloy, the method including melting a magnesium or magnesium alloy into a liquid phase, adding a silicon compound to the molten magnesium or magnesium alloy, removing oxygen elements from the silicon compound through a reduction reaction between the molten magnesium or magnesium alloy and the added silicon compound, and making the silicon produced as a result of the reduction reaction into a compound in the molten magnesium or magnesium alloy.

In accordance with still another aspect of the present invention, there is provided a magnesium-based alloy produced by the method stated above.

Advantageous Effects

As described above, according to the present invention, in order to overcome problems with the conventional production method in which silicon is directly added, a new magnesium-based alloy is produced by adding a silicon compound to molten magnesium or magnesium alloy.

In the method for producing the magnesium-based alloy, the production cost of the magnesium alloy can be reduced using a silicon compound ($SiO_2$), which is relatively cost-efficient, instead of silicon (Si).

In addition, Si produced as a result of a reduction reaction of a silicon compound added is not dissolved in the magnesium alloy but is directly formed as a compound (representatively $Mg_2Si$). Thus, a content of Si to be used in phase formation of the magnesium alloy can be estimated by the amount of Si in the silicon compound. Further, the magnesium alloy is microgranulated by forming a compound, thereby enhancing mechanical physical properties of the magnesium alloy.

In addition, the Si element added to the molten magnesium or magnesium alloy through a reduction reaction of the silicon compound is combined with magnesium elements in the molten magnesium or magnesium alloy, thereby producing a compound that is chemically stable at high temperature. The thus produced compound can enhance physical properties of the magnesium alloy.

MODE FOR CARRYING OUT THE INVENTION

Figure 1:
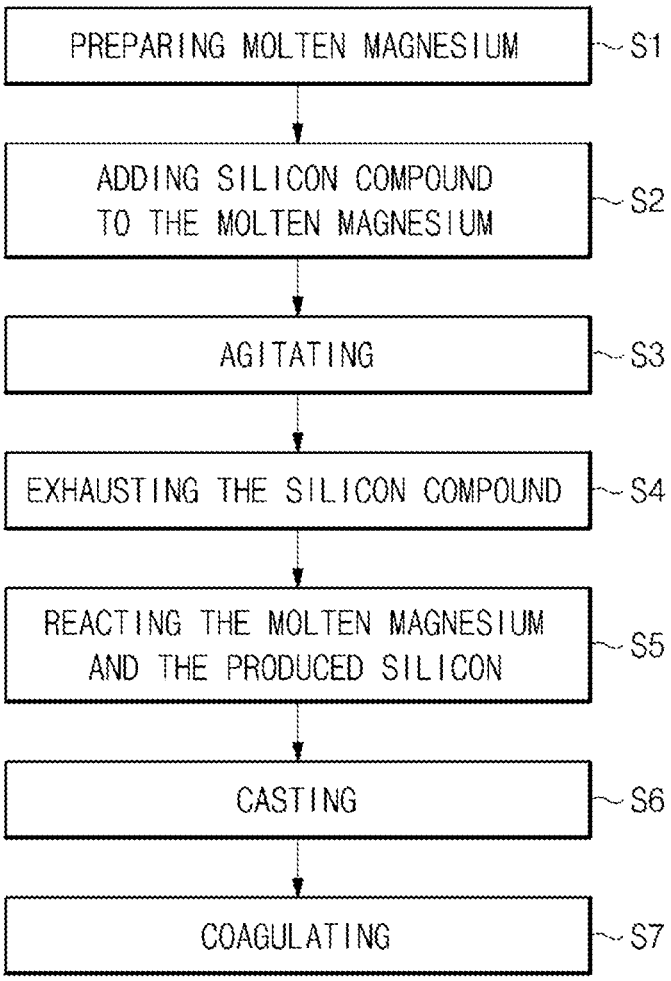
FIG. 1 is a flowchart illustrating a method for producing magnesium (Mg) alloy according to the present invention.

Preferred embodiments of the present invention will be described below in more detail with reference to the accompanying drawings. In every possible case, like reference numerals are used for referring to the same or similar elements in the description and drawings. Moreover, detailed descriptions related to well-known functions or configurations will be ruled out in order not to unnecessarily obscure subject matters of the present invention.

The present invention is directed to a method of producing a new alloy by adding a silicon compound to molten magnesium or magnesium alloy, and an alloy produced thereby.

FIG. 1 is a flowchart illustrating a method for producing magnesium (Mg) alloy according to the present invention.

As illustrated in FIG. 1, the method for producing the magnesium-based alloy according to the present invention includes preparing molten magnesium or magnesium alloy (S1), adding a silicon compound to the molten magnesium or magnesium alloy (S2), agitating (S3), exhausting the silicon compound (S4), reacting the molten magnesium or magnesium alloy and the produced silicon (S5), casting (S6), and coagulating (S7). For the sake of convenient explanation, the exhausting of the silicon compound (S4) and the reacting of the molten magnesium or magnesium alloy and the produced silicon (S5) are illustrated as separate steps. However, the two steps S4 and S5 are almost simultaneously performed. In practice, the steps S4 and S5 may be performed even before the agitating (S3). The steps S4 and S5 may be performed at the same time with adding the silicon compound.

In the preparing of the molten magnesium (S1), magnesium or magnesium alloy is put into a crucible and a temperature of 400 to 800° C. is applied thereto under a stream of protective gas. Then, the magnesium alloy in the crucible is melted, thereby preparing molten magnesium.

Melting Temperature of Magnesium or Magnesium Alloy

In the present invention, a temperature for melting magnesium or magnesium alloy refers to a temperature in which a pure magnesium metal and a magnesium alloy are melted. The melting temperature may vary according to the kind of alloy. In order to make a full reaction take place, a silicon compound is added in a state in which the magnesium or magnesium alloy is completely melted. The melting temperature of magnesium or magnesium alloy is as high as a temperature in which a solid phase metal is sufficiently melted to then exist as a perfect liquid phase. However, considering that the temperature of the molten metal may be lowered with addition of the silicon compound, it is necessary to maintain the molten metal to be in a temperature range having a sufficient margin. In addition, when the silicon compound is added, it may be heated at a predetermined temperature to be added to the molten metal.

Here, if the temperature is lower than 400° C., it is difficult to form molten magnesium alloy, and if the temperature is higher than 800° C., there is a risk of ignition occurring to the molten metal. In metallography, it is generally often the case that the melting point is lowered according to the progress of alloying.

If the melting temperature is excessively raised, evaporation of a liquid metal may occur, and magnesium may be readily evaporated in view of its characteristic, resulting in a loss of the amount of the molten magnesium, thereby adversely affecting final physical properties.

The magnesium used in the preparing of the molten magnesium may be one selected from the group consisting of pure magnesium, a magnesium alloy and equivalents thereof. The magnesium alloy may be one selected from the group consisting of AZ91D, AM20, AM30, AM50, AM60, AZ31, AS41, AS31, AS21X, AE42, AE44, AX51, AX52, AJ50X, AJ52X, AJ62X, MRI153, MRI230, AM-HP2, Mg—Al, Mg—Al—Re, Mg—Al—Sn, Mg—Zn—Sn, Mg—Si, Mg—Zn—Y and equivalents thereof. In the present invention, any type of magnesium alloy used in the industry can be employed.

In the adding of the silicon compound (S2), the silicon compound in a powder phase is added to the molten magnesium. Here, the silicon compound is in a powder phase to promote a reaction between the silicon compound and magnesium alloy.

Powder Phase of Silicon Compound

The silicon compound added to be used in the reaction may be in any phase. In order to increase a reaction surface area for achieving an efficient reaction, the silicon compound in a powder phase is preferably added. However, if the silicon compound in a powder phase has an overly small grain size of less than 0.1 μm, the silicon compound is scattered by evaporated magnesium or hot wind, making it difficult to add the silicon compound into a furnace. In addition, the silicon compound may not be easily mixed due to coagulation, forming lumps of the coagulating silicon compound. If the silicon compound in a powder phase has an overly large grain size, the surface area may be increased, which is not desirable. The grain size of the powdered silicon compound is preferably 500 μm or less, more preferably 200 μm or less.

In order to prevent the silicon compound in the powder phase from scattering, a pellet-type silicon compound prepared by coagulating the silicon compound in the powder phase may also be added.

Silicon Compound Added

As the silicon compound added to the molten magnesium alloy, $SiO_2$ may be used. However, the present invention does not limit the added silicon compound to $SiO_2$, but any type of silicon compound may be used as the added silicon compound.

An amount of the silicon compound used in the adding of the silicon compound depends on an amount of the molten magnesium or magnesium alloy. The silicon compound may be added to the molten magnesium or magnesium alloy in an amount enough to fully react with the molten magnesium or magnesium alloy to be completely exhausted such that the silicon compound does not substantially remain in the final magnesium alloy. Alternatively, the silicon compound may also be added in an amount so as not to remain in the molten magnesium or magnesium alloy. If an excess amount of the silicon compound is added, the silicon compound may be removed with dross of the molten magnesium or magnesium alloy or may be removed after tapping. When the silicon compound is added in an amount of 30 wt % based on the amount of the molten magnesium or magnesium alloy, the experiment results showed that a reduction reaction of the silicon compound was easily carried out in the molten magnesium or magnesium alloy. If the silicon compound is added in an amount of less than 0.001 wt %, the effect of adding the silicon compound was negligible in producing the magnesium alloy.

The amount of the added silicon compound is determined according to the composition of a final target alloy. That is to say, the amount of the added silicon compound may be determined by calculating backwards according to the amount of silicon desired to be alloyed in the magnesium alloy.

In the agitating (S3), each 0.1 wt % of the silicon compound added to the molten magnesium or magnesium alloy is agitated for 1 second to 60 minutes.

If the agitating time is less than 1 sec for each 0.1 wt % of the silicon compound, the silicon compound does not fully react with the molten magnesium. If the agitating time exceeds 60 min for each 0.1 wt % of the silicon compound, the agitating of the molten magnesium may be unnecessarily prolonged. The agitating time generally depend on the size of the molten magnesium and the amount of the added silicon compound.

The amount of the compound powder needed to be added may be used at once. However, in order to promote a reaction and to reduce a probability of coagulation of the compound powder, the compound powder is first added and further sequentially added in appropriate amounts with a time difference after the first addition. Accordingly, a reaction may be induced to take place on a surface.

Agitating Method and Condition

In the present invention, in order to achieve an efficient reduction reaction between the magnesium or magnesium alloy and the silicon compound, agitating is preferably performed. The agitating is performed by providing an apparatus capable of applying an electromagnetic field to a furnace containing molten magnesium or magnesium alloy and generating the electromagnetic field, thereby inducing convection of the molten magnesium or magnesium alloy. In addition, the agitating may be externally performed on the molten magnesium or magnesium alloy through artificial agitation (mechanical agitation). In a case of mechanical agitation, the agitating may be appropriately performed to prevent the added silicon compound powder from coagulating. The agitating is fundamentally performed for the purpose of inducing an appropriate reaction between the molten magnesium or magnesium alloy and the added silicon compound powder.

A time required for agitating may vary according to the temperature of the molten magnesium or magnesium alloy and the state of the added silicon compound powder (a pre-heated state, etc.). Preferably, the agitating is basically performed until the added silicon compound powder is not seen from a surface of the molten magnesium or magnesium alloy. That is to say, the agitating is preferably performed until a full reaction between the molten magnesium or magnesium alloy and the silicon compound takes place. Here, the full reaction refers to a state in which the silicon compound is completely exhausted through a reduction reaction with the molten magnesium or magnesium alloy.

The specific gravity of the silicon compound ($SiO_2$) is greater than that of the magnesium or magnesium alloy. Therefore, the silicon compound is settled down into the molten magnesium or magnesium alloy. However, in a case where the silicon compound is in a powder phase, since the viscosity of the molten magnesium or magnesium alloy is more influential than the specific gravity of the molten magnesium or magnesium alloy, the silicon compound is highly probable to float on the surface of the molten magnesium or magnesium alloy without being settled down into the molten magnesium or magnesium alloy. Therefore, in the present invention, since the silicon compound is in a powder phase, the agitating of the silicon compound is performed on a top layer of the silicon compound. In a case where the silicon compound is settled down due to a difference in the specific gravity and remains, the remaining silicon compound may be adjustably removed after tapping in the course of producing the magnesium alloy.

An agitating time long enough to allow unreacted powder to react is preferably given while having a holding time even after the long agitating time.

Agitating Timing

The agitating is concurrently performed with adding of the compound powder. The agitating is continuously performed until the compound powder added to the molten magnesium or magnesium alloy. The added compound is completely exhausted in the reduction reaction, thereby completing the agitating.

Surface Reaction

In general, in order to produce a metal alloy, a molten metal is simply stirred for the purpose of facilitating melting of pure silicon. Meanwhile, a molten metal and an alloy element are subjected to convection or agitation (stirring) to induce an active reaction, thereby allowing the reaction to take place in the molten metal.

In the present invention, the convection or agitation is employed. In addition, the silicon compound is added to the surface of the molten magnesium or magnesium alloy and agitated to facilitate the reaction. That is to say, both a reaction taking place in the molten magnesium or magnesium alloy and a reaction taking place on the surface of the molten magnesium or magnesium alloy are induced, thereby maximizing the reduction reaction of the silicon compound.

In the present invention, it is important to construct reaction conditions to allow the compound to react on the surface of the molten magnesium or magnesium alloy rather than in the molten magnesium or magnesium alloy. To this end, importantly, the compound floating on the surface of the molten magnesium or magnesium alloy may not be forcibly stirred into the molten magnesium or magnesium alloy. That is to say, if the added silicon compound is mixed into the molten magnesium or magnesium alloy without floating on the top layer of the molten magnesium or magnesium alloy, the reduction reaction, in which oxygen is separated from the silicon compound, does not easily take place. It is important to evenly spread the simply floating compound on the surface of the molten magnesium or magnesium alloy.

The reaction takes place more in a case of performing agitating than in a case of not performing agitating. In addition, the reaction takes place more on an outer surface (a top layer surface) of the molten magnesium or magnesium alloy than in the inside of the molten magnesium or magnesium alloy. That is to say, the reaction between the outer surface (the top layer surface) and the powder exposed to the air was carried out efficiently. In order to induce a reduction reaction of the silicon compound, it was better for the molten magnesium or magnesium alloy to be exposed to the air. In order to achieve a full reaction, it is necessary to induce a surface reaction by agitating the top layer. To this end, in order to prevent the silicon compound from being settled down, it is important to induce surface agitation immediately when the silicon compound is added to the molten magnesium or magnesium alloy. In addition, the silicon compound may be added sequentially in an appropriate amount in consideration of the surface area of the molten magnesium or magnesium alloy, rather than simultaneously in an excessive amount, thereby increasing the opportunity of the reaction of the silicon compound on the surface of the molten magnesium or magnesium alloy.

Oxygen elements in the silicon compound are substantially removed on the surface of the molten magnesium or magnesium alloy by agitating the top layer of the molten magnesium or magnesium alloy. The agitating is preferably performed on the top layer of approximately 20% of the overall depth of the molten magnesium or magnesium alloy from the surface of the molten magnesium or magnesium alloy. However, it is difficult to carry out a surface reaction proposed in a preferred embodiment of the present invention at a depth of 20% or greater. The agitating is more preferably performed on the top layer of approximately 10% of the overall depth of the molten magnesium or magnesium alloy from the surface of the molten magnesium or magnesium alloy, which is for the purpose of minimizing disturbance of the molten magnesium or magnesium alloy by causing the floating silicon compound to be positioned on the top layer of approximately 10% of the overall depth of the molten magnesium or magnesium alloy.

In the exhausting of the silicon compound (S4), the silicon compound is exhausted through the reaction between the molten magnesium or magnesium alloy and the added silicon compound such that the silicon compound does not at least partially or substantially remain in the final magnesium alloy. The silicon compound added in the present invention is preferably completely exhausted by the reduction reaction. However, even if some of the silicon compound is not reacted but remains in the magnesium alloy, it may be applied to the present invention as long as the unreacted remaining silicon compound does not considerably affect physical properties of the magnesium alloy.

Here, the exhausting of the silicon compound means removing oxygen elements from the silicon compound. The oxygen elements in the silicon compound may be removed in the form of oxygen ($O_2$) gas or in the form of dross or sludge through a combination of magnesium elements in the molten magnesium or magnesium alloy and/or magnesium alloy elements.

In the reacting of the molten magnesium or magnesium alloy and the produced silicon (S5), the molten magnesium or magnesium alloy and the produced silicon are reacted such that the silicon produced as a result of the exhausting of the silicon compound does not substantially remain in the magnesium alloy. Here, the silicon produced as a result of the exhausting of the silicon compound does not substantially remain by forming a compound with at least one of magnesium in the magnesium alloy and other alloy elements. Here, the silicon compound functions as a silicon supply source.

Figure 2:
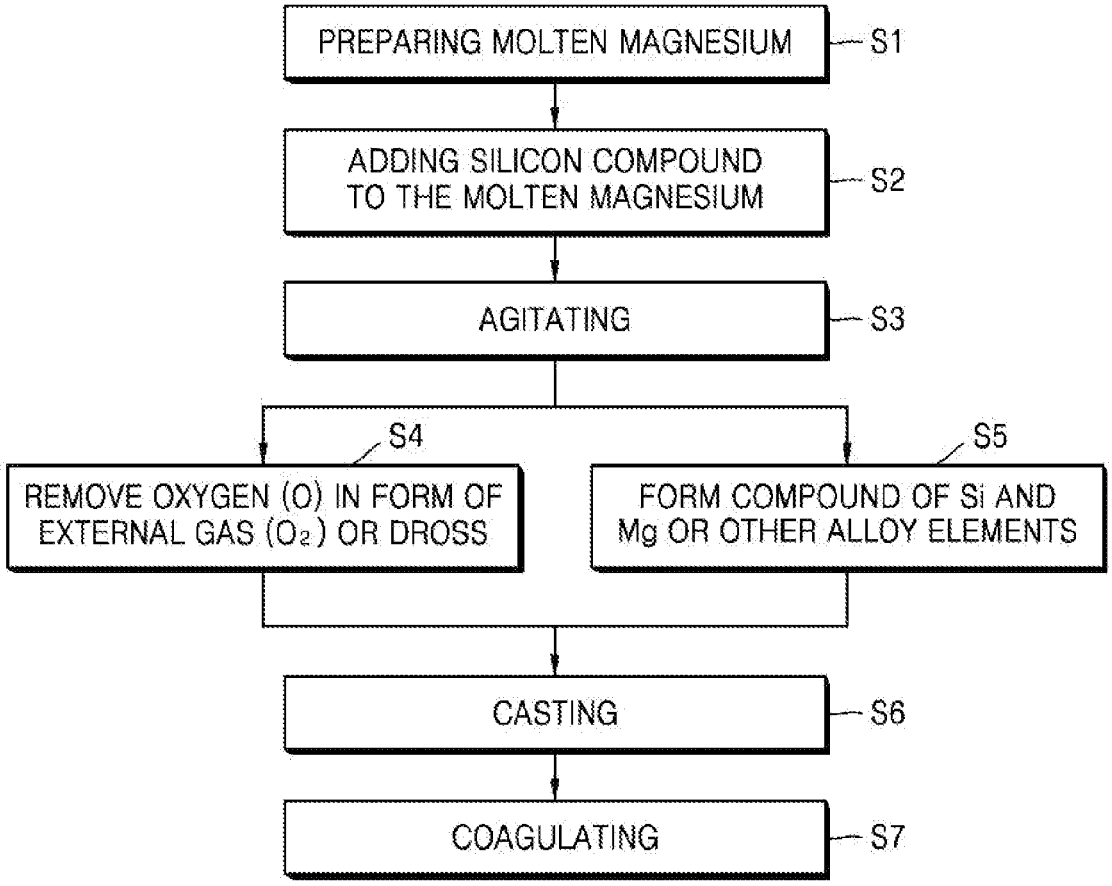
FIG. 2 is a flowchart illustrating dissociation of a silicon compound added to molten magnesium in the present invention.

Eventually, the oxygen elements of the added silicon compound are at least partially or substantially removed through a reaction with the molten magnesium or magnesium alloy, the silicon produced as a result of the removing of the oxygen elements is combined with at least one of magnesium in the magnesium alloy and other alloy elements in the molten magnesium or magnesium alloy to form a compound such that the produced silicon does not at least partially or substantially remain in the magnesium alloy. The above-described procedure is illustrated in FIGS. 1 and 2. FIG. 2 is a flowchart illustrating dissociation of a silicon compound added to molten magnesium in the present invention.

Meanwhile, in the casting (S6), the molten magnesium is put into a mold at a room temperature or in a pre-heated state and then cast. Here, the mold may be one selected from the group consisting of a die, a ceramic mold, a graphite mold and equivalents thereof. In addition, the casting may include gravity pressure casting, continuous casting and equivalents thereof.

In the coagulating (S7), the mold is cooled to room temperature and a magnesium alloy ingot is taken out from the mold. The magnesium alloy produced by the above-described method may include at least one of magnesium in the magnesium-based alloy, aluminum and other alloy elements in the molten magnesium or magnesium alloy, which will be below described.

In a case of pure molten magnesium, magnesium elements in the molten magnesium or magnesium alloy reacts with silicon to form a magnesium (silicon) compound. For example, in a case where the silicon compound is $SiO_2$, $Mg_2Si$ is formed. Oxygen elements constituting $SiO_2$ may become $O_2$ to then be drained out from the molten magnesium or magnesium alloy or may combine with magnesium to become MgO and may then be exhausted in the form of dross (Refer to Reaction Scheme 1).

Pure $Mg+SiO_2 \rightarrow Mg(Matrix)+Mg_2Si$ . . . [$O_2$ formation+MgO dross formation] Reaction Scheme 1

In a case of a molten magnesium alloy, magnesium elements in the molten magnesium alloy reacts with silicon to form a magnesium (silicon) compound. In addition, magnesium, aluminum and an alloy element may form a silicon compound. For example, in a case where the silicon compound is $SiO_2$, $Mg_2Si$ or (Mg, Al, or other alloy element) Si is formed. Oxygen elements constituting $SiO_2$ may become $O_2$, like in the case of pure magnesium, to then be drained out from the molten magnesium alloy, or may combine with magnesium to become MgO and may then be drained in the form of dross (Refer to Reaction Scheme 2).

Mg Alloy+$SiO_2$->Mg Alloy(Matrix)+($Mg_2Si$+(Mg, Al, or other alloy element)Si) . . . [$O_2$ formation+MgO dross formation] Reaction Scheme 2

As described above, the present invention provides a method for producing the magnesium alloy, which is a more economically efficient manner than the conventional method for producing the magnesium alloy. In the present invention, since a silicon compound, instead of silicon, is added to the magnesium or magnesium alloy, it is relatively easy to form an alloy. Since a chemically stable silicon compound is added, rather than directly adding silicon, a phase of a compound of $Mg_2Si$ or Mg/Al and Si can be directly produced, which importantly affects physical properties of the alloy. Accordingly, the produced magnesium alloy may have a microgranulated structure and an enhanced mechanical strength.

In addition, unlike in a case where a constant amount of dissolution of silicon (Si) occurs to the magnesium alloy due to directly adding of Si to the magnesium or magnesium alloy, none or an extremely little amount of dissolution of silicon occurs in the present invention in which the silicon compound is added. Therefore, when the silicon compound is added to produce a magnesium alloy, silicon is combined with magnesium and other alloy elements to produce a compound, thereby enhancing physical properties of the formed alloy, compared to a case where silicon is directly added.

The magnesium-based alloy produced according to the present invention may be used as at least one selected from the group consisting of a casting alloy, a wrought alloy, a creep alloy, a damping alloy, a degradable bio alloy and powder metallurgy alloy.

The magnesium-based alloy produced according to the present invention may have a Rockwell hardness (HRF) scale in a range of 40 to 80. However, since the HRF scale may change in various manners according to the pressing method and heat treatment, the present invention does not limit the HRF scale of the magnesium-based alloy to those in the range stated above.

Table 1 shows HRF scales of the magnesium alloy produced according to the present invention, as measured at a room temperature by producing the magnesium alloy by adding 0.5 wt % silicon oxide ($SiO_2$) to pure magnesium.

TABLE 1

| Specimen No. | 1 | 2 | 3 | 4 | 5 | 6 | 7 | Average |
|---|---|---|---|---|---|---|---|---|
| Hardness (HR15T) | 39 | 41 | 36 | 42 | 42 | 36 | 39 | 39.3 |

Table 2 shows HRF scales of the magnesium alloy produced according to the present invention, as measured at a room temperature by producing the magnesium alloy by adding 0.5 wt % silicon oxide ($SiO_2$) to AM60 as a magnesium alloy.

TABLE 2

| Specimen No. | 1 | 2 | 3 | 4 | 5 | 6 | 7 | Average |
|---|---|---|---|---|---|---|---|---|
| Hardness (HRF) | 43 | 44 | 46 | 42 | 43 | 41 | 44 | 43.3 |

The magnesium alloy produced in the present invention had a higher HRF scale than the same kind of magnesium alloy in the related art for the following reason. That is to say, the silicon resulting from a reduction reaction forms a compound through a combination with of magnesium and/or other alloy elements in the magnesium or magnesium alloy.

In particular, the produced $Mg_2Si$ has a relatively high HRF scale, low thermal expansion coefficient, and a high melting point of 1085° C., suggesting that the magnesium alloy has enhanced mechanical physical properties.

Figure 3:
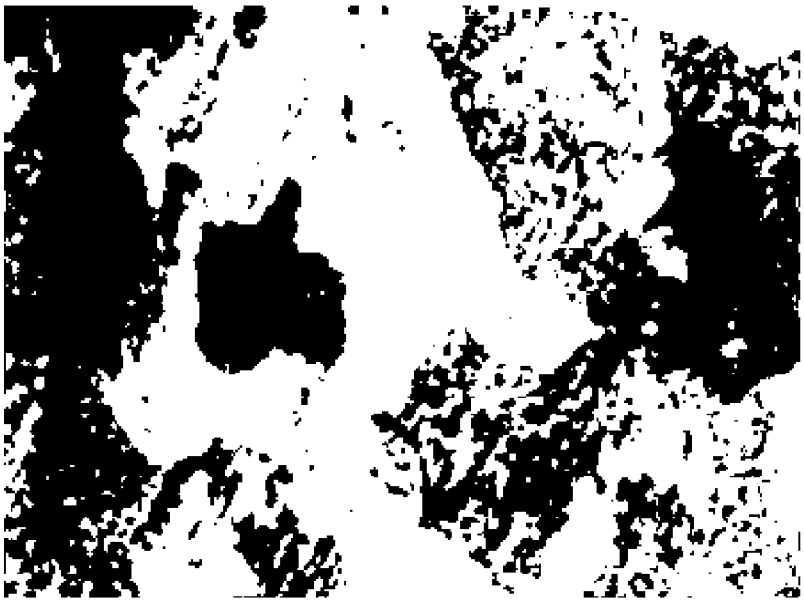
FIG. 3 is a photograph (×50) showing a structure of magnesium (Mg) alloy produced by adding 0.5 wt % $SiO_2$ to Mg according to the present invention.
Figure 4:
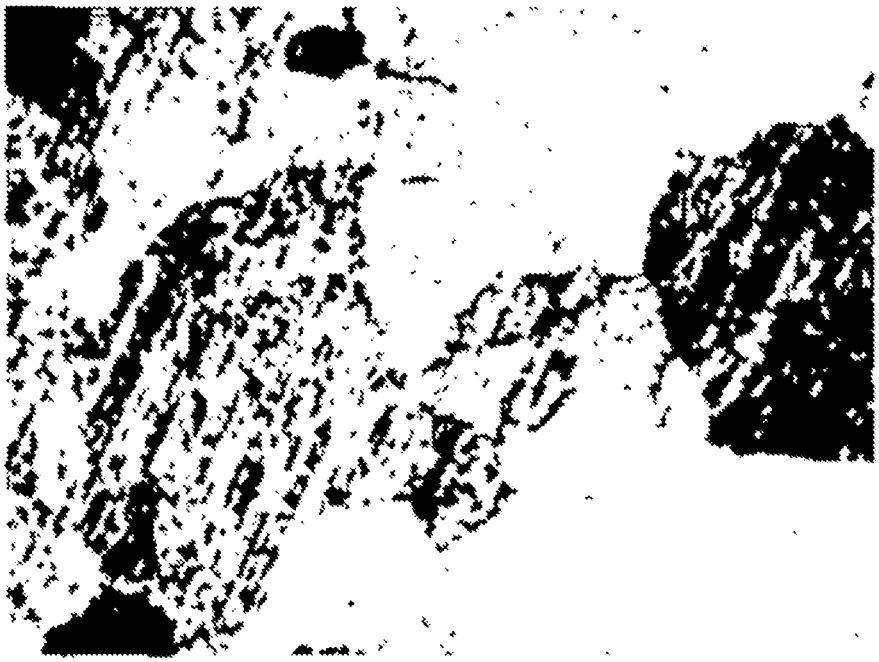
FIG. 4 is a photograph (×100) showing a structure of magnesium (Mg) alloy produced by adding 0.5 wt % $SiO_2$ to Mg according to the present invention.
Figure 5:
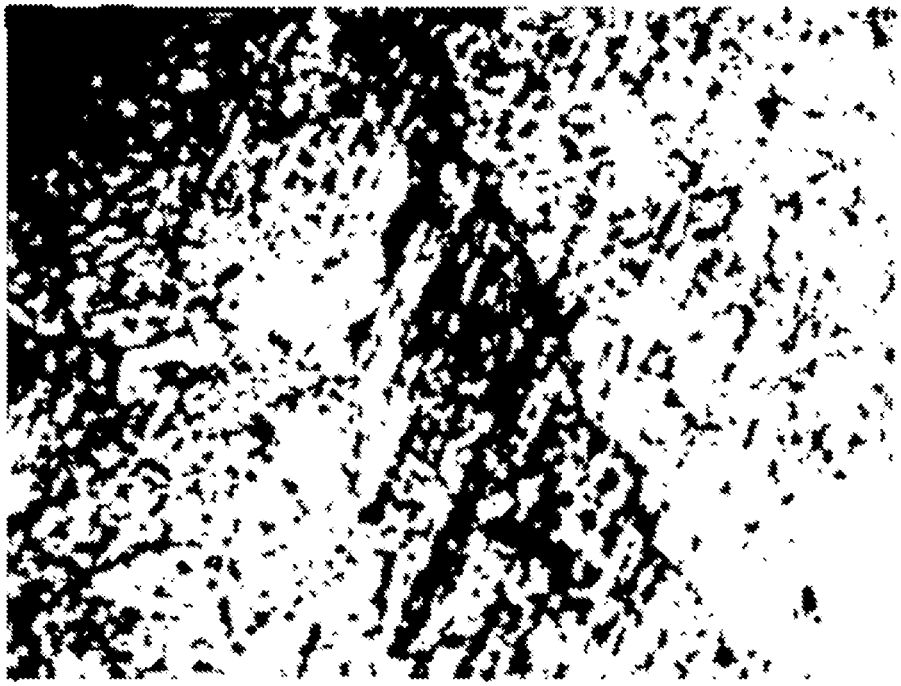
FIG. 5 is a photograph (×200) showing a structure of magnesium (Mg) alloy produced by adding 0.5 wt % $SiO_2$ to Mg according to the present invention.

FIGS. 3, 4 and 5 are photographs (×50, ×100 and ×200) showing structures of magnesium alloys produced by adding 0.5 wt % $SiO_2$ to Mg according to the present invention, respectively.

Figure 11:
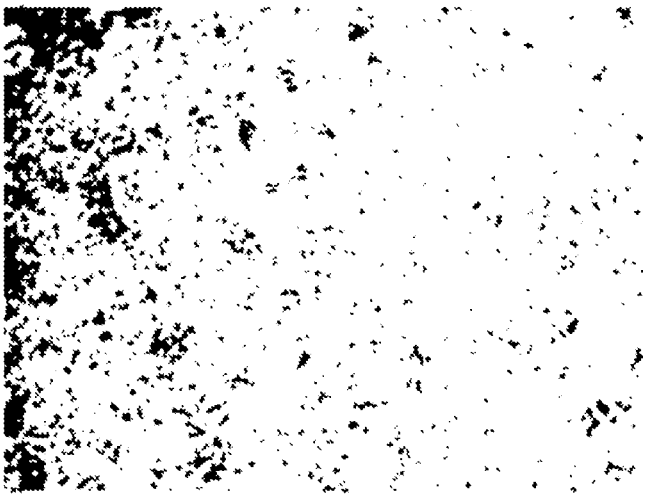
FIG. 11 is a photograph (×50) showing a structure of magnesium (Mg) alloy produced by adding 0.5 wt % $SiO_2$ to magnesium (Mg) alloy (AM 60) according to the present invention.
Figure 12:
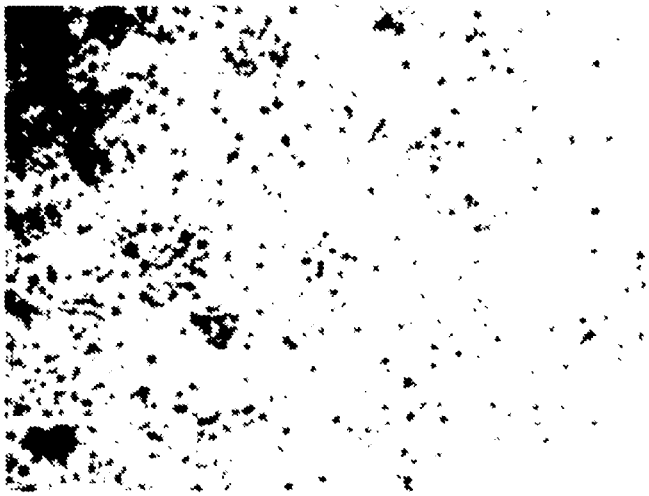
FIG. 12 is a photograph (×100) showing a structure of magnesium (Mg) alloy produced by adding 0.5 wt % $SiO_2$ to magnesium (Mg) alloy (AM 60) according to the present invention.
Figure 13:
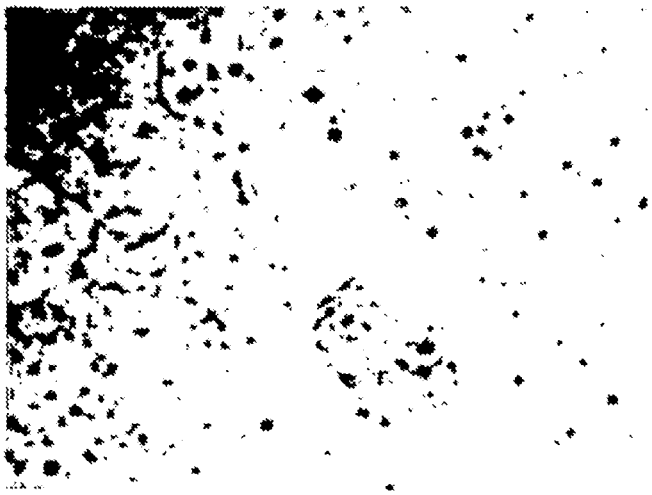
FIG. 13 is a photograph (×200) showing a structure of magnesium (Mg) alloy produced by adding 0.5 wt % $SiO_2$ to magnesium (Mg) alloy (AM 60) according to the present invention.

FIGS. 11, 12 and 13 are photographs (×50, ×100 and ×200) showing structures of magnesium alloys produced by adding 0.5 wt % $SiO_2$ to magnesium alloy (AM 60) according to the present invention, respectively. As confirmed from the above photographs, the magnesium alloys produced by adding $SiO_2$ to the molten magnesium or magnesium alloy had microgranulated structures, which is because growth of microgranules was suppressed by the compound produced between the silicon resulting from a reduction reaction and magnesium and/or other alloy due to phase formation. It was confirmed that the magnesium alloy according to the present invention, produced by addition of $SiO_2$ had a noticeably reduced grain size to have microgranulated structures, compared to pure magnesium alloy.

Figure 6:
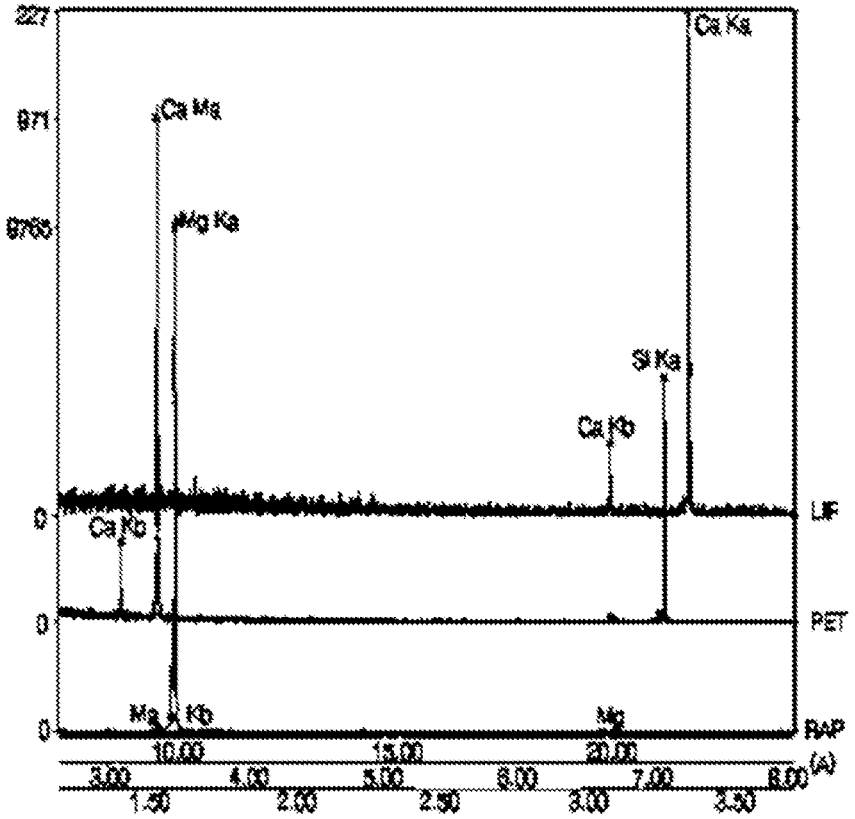
FIG. 6 is a graph illustrating points of a magnesium (Mg) alloy produced by adding 0.5 wt % $SiO_2$ to Mg according to the present invention, as analyzed by an electron probe micro analyzer (EPMA)

FIG. 6 is a graph illustrating points of a magnesium alloy produced by adding 0.5 wt % $SiO_2$ to Mg according to the present invention, as analyzed by an electron probe micro analyzer (EPMA).

TABLE 3

| | Mg | Si | Total |
|---|---|---|---|
| Point 1 | 90.96 | 9.04 | 100 |
| Point 2 | 81.16 | 18.84 | 100 |
| Point 3 | 84.44 | 15.56 | 100 |

Figure 7:
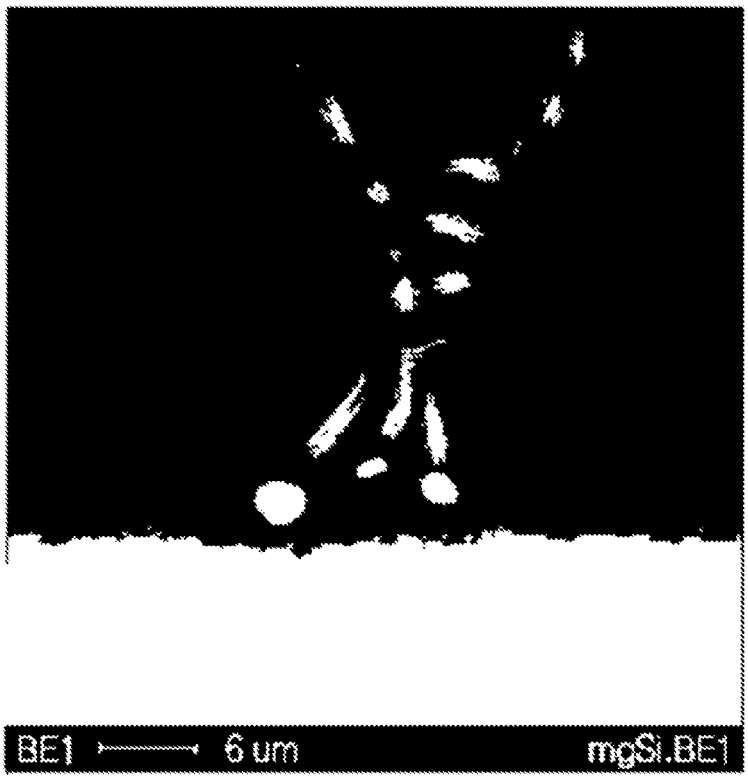
FIG. 7 is a scanning electron microscope (SEM) image photograph showing a polished surface of a magnesium (Mg) alloy produced by adding 0.5 wt % $SiO_2$ to Mg according to the present invention.

FIG. 7 is a scanning electron microscope (SEM) image photograph showing a polished surface of a magnesium alloy produced by adding 0.5 wt % $SiO_2$ to Mg according to the present invention. From the SEM image photograph, a vague grain boundary was identified.

Figure 8:
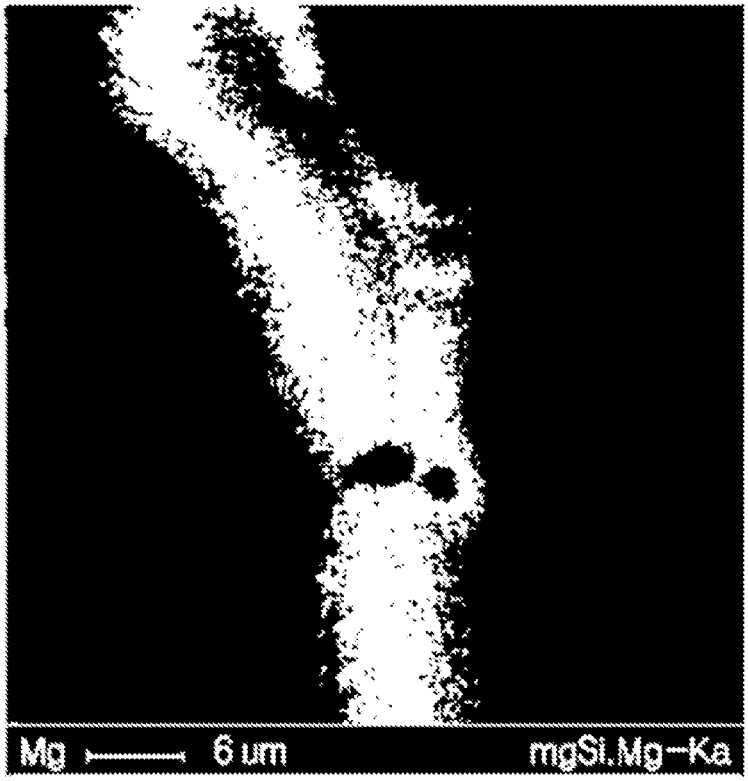
FIG. 8 is a photograph showing magnesium (Mg) mapping analysis of a magnesium (Mg) alloy produced by adding 0.5 wt % $SiO_2$ to Mg according to the present invention.

FIG. 8 is a photograph showing magnesium (Mg) mapping analysis of a magnesium alloy produced by adding 0.5 wt % $SiO_2$ to Mg according to the present invention. It was confirmed from the Mg mapping analysis that Mg elements existed all over the regions of specimens.

Figure 9:
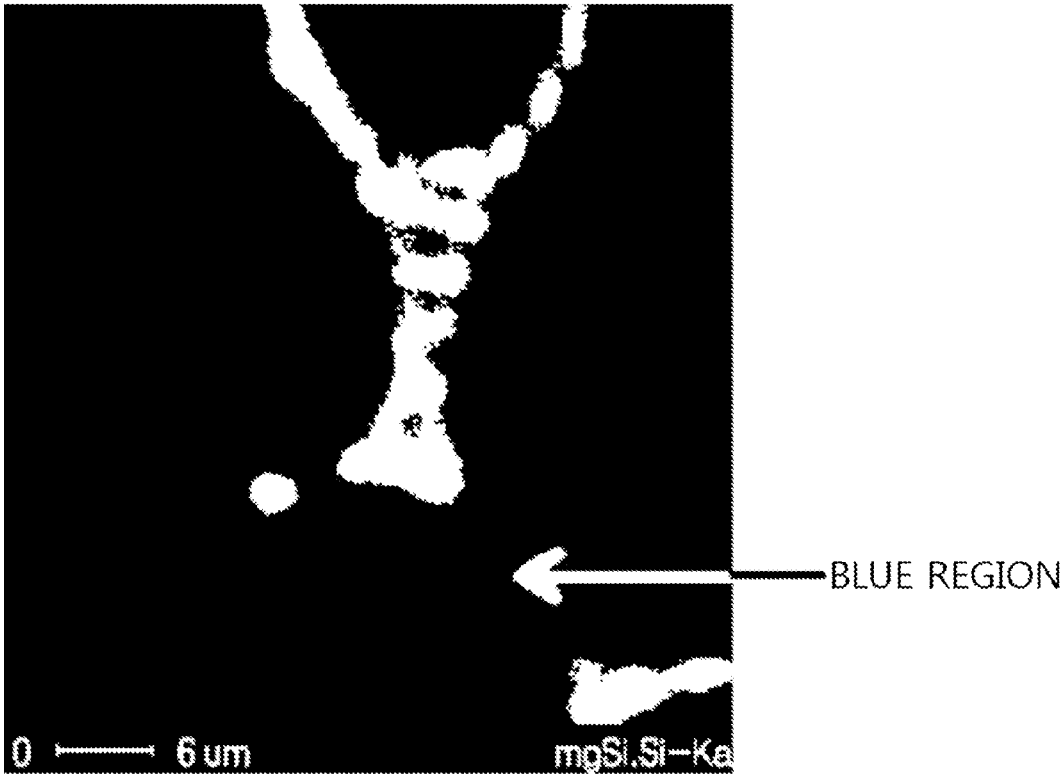
FIG. 9 is a photograph showing silicon (Si) mapping analysis of a magnesium (Mg) alloy produced by adding 0.5 wt % $SiO_2$ to Mg according to the present invention.

FIG. 9 is a photograph showing silicon (Si) mapping analysis of a magnesium alloy produced by adding 0.5 wt % $SiO_2$ to Mg according to the present invention. In the photograph of FIG. 9, the blue region is a silicon-free region. As shown in FIGS. 7 and 8, an Si region overlaps with an Mg region, indirectly suggesting that Mg and Si are combined with each other to produce a compound, which is because Si separated from $SiO_2$ is not dissolved in an Mg base but is used in forming a phase with Mg (or other alloy elements).

Figure 10:
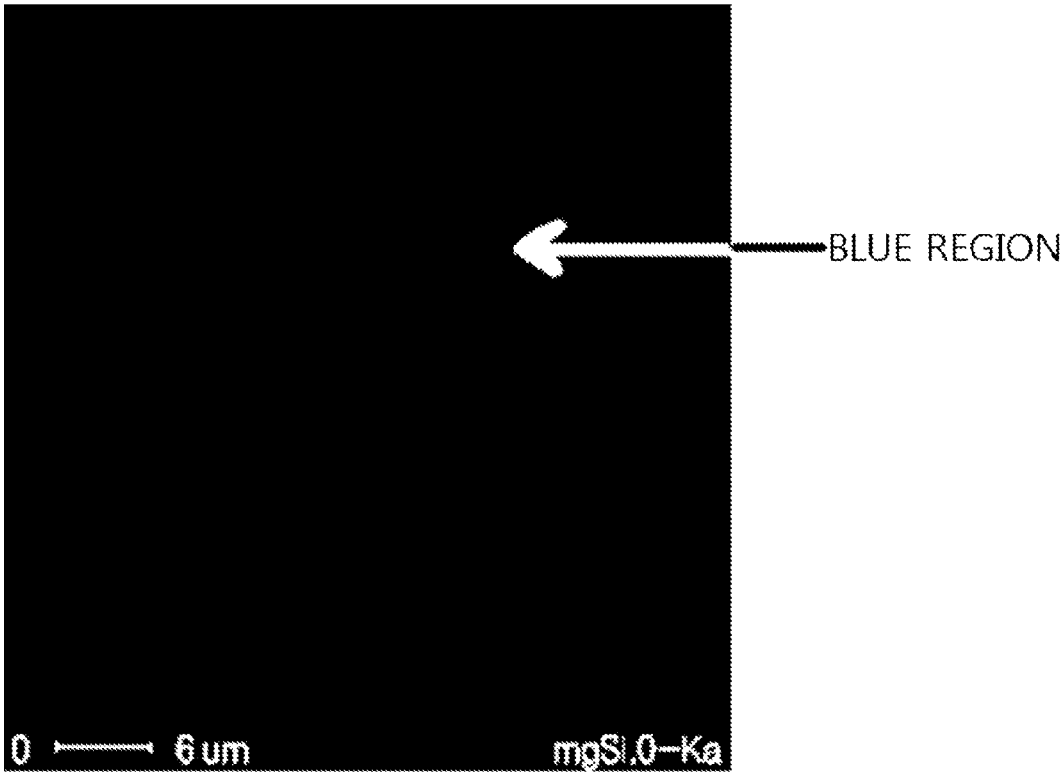
FIG. 10 is a photograph showing oxygen (O) mapping analysis of a magnesium (Mg) alloy produced by adding 0.5 wt % $SiO_2$ to Mg according to the present invention.

Referring to FIG. 10, it was confirmed that no oxygen elements existed in the alloy, which suggests that the oxygen elements are removed from $SiO_2$ added to the magnesium alloy in the form of oxygen ($O_2$) gas or in the form of dross of MgO (or a compound of Al or other alloy elements) in the molten magnesium or magnesium.

Figure 14:
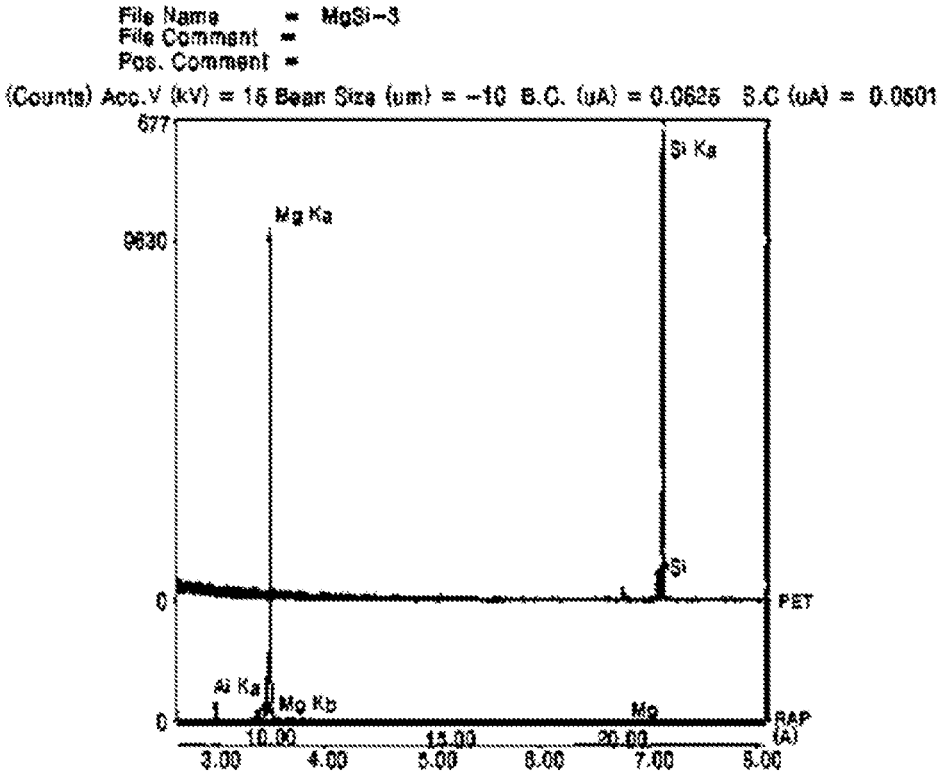
FIG. 14 is a graph illustrating points of a magnesium (Mg) alloy produced by adding 0.5 wt % $SiO_2$ to magnesium (Mg) alloy (AM 60) according to the present invention, as analyzed by EPMA.

FIG. 14 is a graph illustrating points of a magnesium alloy produced by adding 0.5 wt % $SiO_2$ to magnesium alloy (AM 60) according to the present invention, as analyzed by EPMA. From the point analysis of the compound involved in phase formation, it was confirmed that a magnesium-silicon based compound was produced by directly adding silicon oxide (SiO2) to the molten magnesium alloy.

Table 4 shows proportions of ratios of Mg, Al and Si, as counted at various points 1, 2 and 3, respectively.

TABLE 4

| | Mg | Al | Si | Total |
|---|---|---|---|---|
| Point 1 | 78.96 | 3.59 | 17.45 | 100 |
| Point 2 | 70.11 | 3.18 | 26.71 | 100 |
| Point 3 | 77.62 | 3.15 | 19.23 | 100 |

Figure 15:
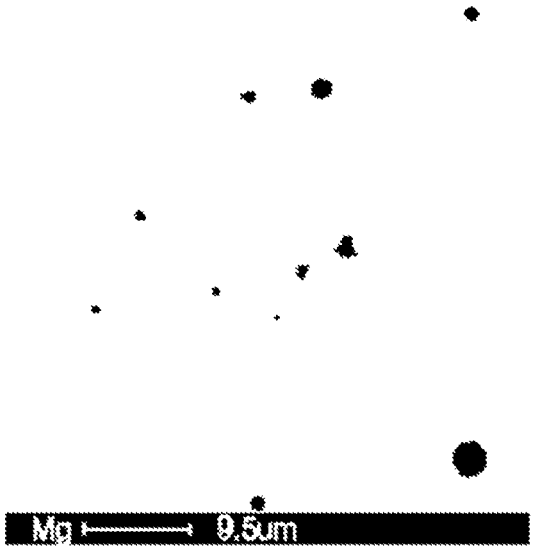
FIG. 15 is a photograph showing magnesium (Mg) mapping analysis of a magnesium (Mg) alloy produced by adding 0.5 wt % $SiO_2$ to magnesium (Mg) alloy (AM 60) according to the present invention.

FIG. 15 is a photograph showing magnesium (Mg) mapping analysis of a magnesium alloy produced by adding 0.5 wt % $SiO_2$ to magnesium alloy (AM 60) according to the present invention. It was confirmed from the Mg mapping analysis that Mg elements existed all over the regions of specimens.

Figure 16:
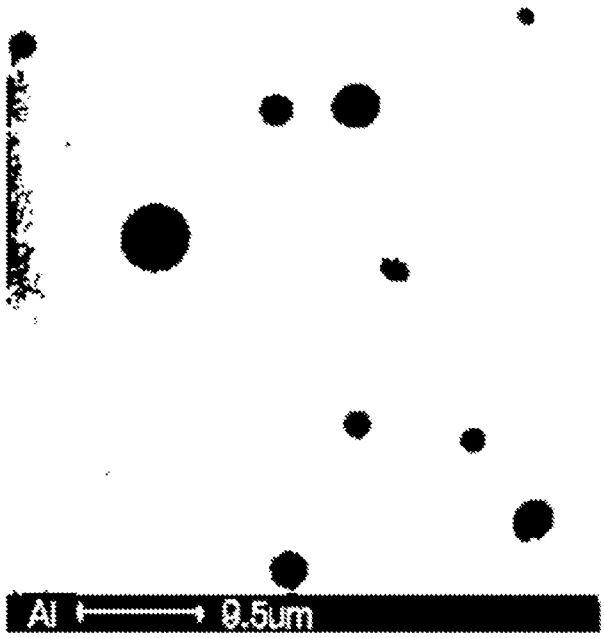
FIG. 16 is a photograph showing aluminum (Al) mapping analysis of a magnesium (Mg) alloy produced by adding 0.5 wt % $SiO_2$ to magnesium (Mg) alloy (AM 60) according to the present invention.

FIG. 16 is a photograph showing aluminum (Al) mapping analysis of a magnesium alloy produced by adding 0.5 wt % $SiO_2$ to magnesium alloy (AM 60) according to the present invention. It was confirmed from the Al mapping analysis that Al elements existed along grain boundaries of specimens.

Figure 17:
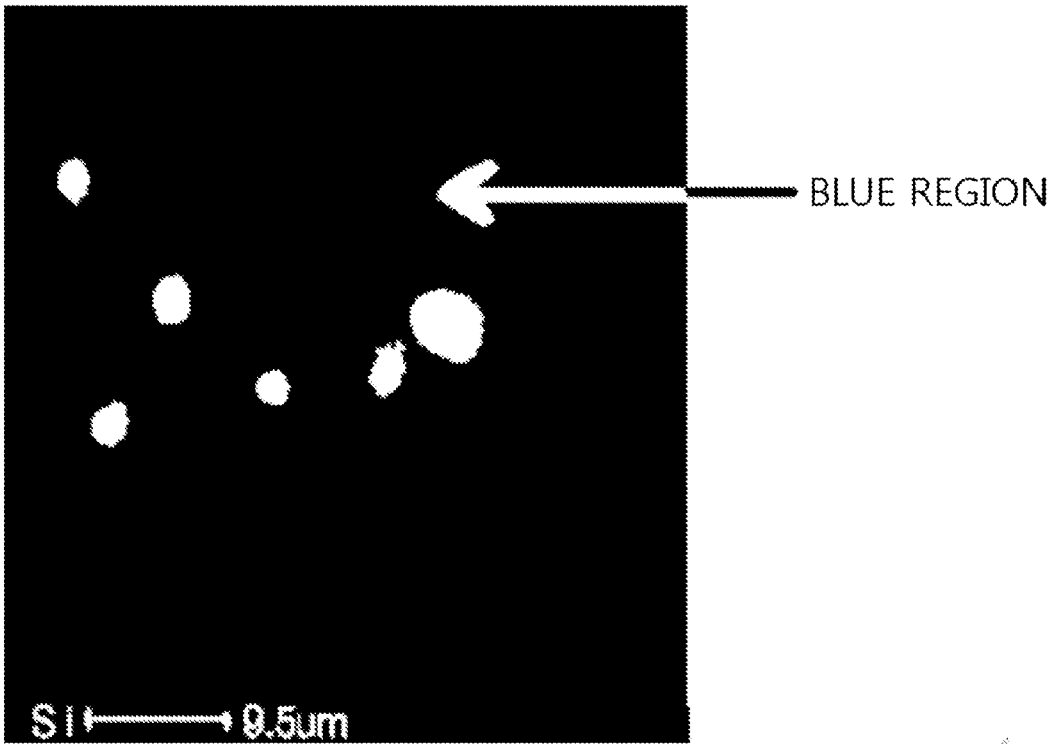
FIG. 17 is a photograph showing silicon (Si) mapping analysis of a magnesium (Mg) alloy produced by adding 0.5 wt % $SiO_2$ to magnesium (Mg) alloy (AM 60) according to the present invention.

FIG. 17 is a photograph showing silicon (Si) mapping analysis of a magnesium alloy produced by adding 0.5 wt % $SiO_2$ to magnesium alloy (AM 60) according to the present invention. In the photograph of FIG. 17, the blue region is a silicon-free region. It was confirmed that an Si region shown in FIG. 17 overlaps with an Al region shown FIG. 16, indirectly suggesting that Mg, Si and Al are combined with one another to produce a compound, which is because Si separated from $SiO_2$ is not dissolved in an Mg base but is involved in phase formation with Mg and Al as another alloy element.

Figure 18:
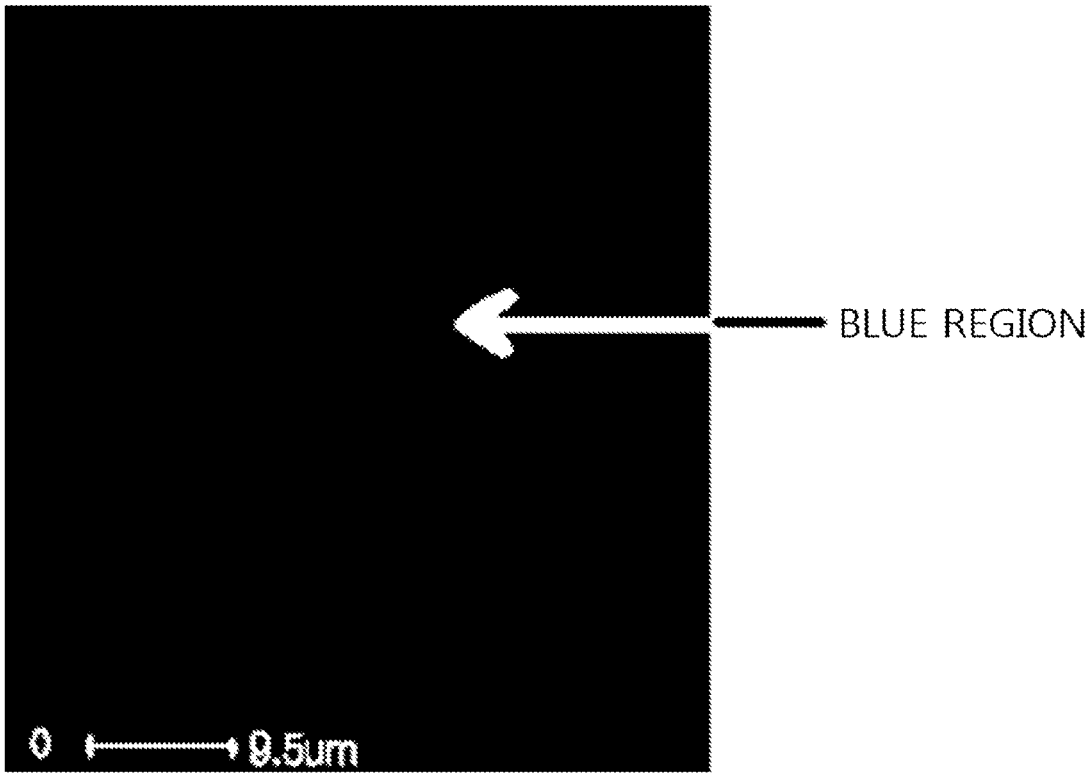
FIG. 18 is a photograph showing oxygen (O) mapping analysis of a magnesium (Mg) alloy produced by adding 0.5 wt % $SiO_2$ to magnesium (Mg) alloy (AM 60) according to the present invention.

FIG. 18 is a photograph showing oxygen (O) mapping analysis of a magnesium alloy produced by adding 0.5 wt % $SiO_2$ to magnesium alloy (AM 60) according to the present invention. Referring to FIG. 18, it is confirmed that no oxygen elements existed in the alloy, which suggests that the oxygen elements are removed from SiO2 added to the magnesium alloy in the form of oxygen (O2) gas or in the form of dross of MgO (or a compound of Al or other alloy elements) in the molten magnesium or magnesium.

As described above, according to the present invention, problems with the conventional alloy production method in which silicon is directly added, can be solved by producing a new magnesium based alloy by adding the silicon compound to the molten magnesium or magnesium alloy.

The silicon resulting from a reduction reaction of the added silicon compound is not dissolved in the magnesium alloy, but a phase of a compound (representatively $Mg_2Si$) is directly formed. The magnesium alloy has a microgranulated structure due to phase formation, thereby enhancing mechanical properties.

That is to say, the Si element added to the molten magnesium or magnesium alloy through a reduction reaction of the silicon compound is combined with magnesium elements or other alloy elements, thereby producing a compound that is chemically stable at high temperature. The thus produced compound can enhance physical properties of the magnesium alloy.

Although exemplary embodiments of the present invention have been described in detail hereinabove, it should be understood that many variations and modifications of the basic inventive concept herein described, which may appear to those skilled in the art, will still fall within the spirit and scope of the exemplary embodiments of the present invention as defined by the appended claims.

The invention claimed is:

1. A method for producing a magnesium-based alloy, the method comprising:

melting a magnesium or magnesium alloy into a liquid phase;

adding a silicon compound to the molten magnesium or magnesium alloy;

evenly spreading the added silicon compound on the molten magnesium or magnesium alloy such that the added silicon compound is not mixed into the molten magnesium or magnesium alloy;

exhausting at least some of the silicon compound in the molten magnesium or magnesium alloy through a full reaction between the molten magnesium or magnesium alloy and the added silicon compound such that the silicon compound does not substantially remain in the magnesium alloy; and reacting at least some of the silicon produced as a result of the exhausting in the molten magnesium or magnesium alloy.

2. A method for producing a magnesium-based alloy, the method comprising:

melting a magnesium or magnesium alloy into a liquid phase;

adding a silicon compound to the molten magnesium or magnesium alloy;

evenly spreading the added silicon compound on the molten magnesium or magnesium alloy such that the added silicon compound is not mixed into the molten magnesium or magnesium alloy;

exhausting the silicon compound through a full reaction between the molten magnesium alloy and the added silicon compound such that the silicon compound does not substantially remain in the magnesium alloy; and reacting the silicon produced as a result of the exhausting such that the silicon compound does not substantially remain in the magnesium alloy.

3. The method of claim 2, wherein oxygen elements in the silicon compound are removed in the form of oxygen gas or in the form of dross through a combination of magnesium elements in the molten magnesium or magnesium alloy and/or magnesium alloy elements.

4. The method of claim 2, wherein the reaction between the molten magnesium or magnesium alloy and the added silicon compound is promoted by agitating the molten magnesium or magnesium alloy.

5. The method of claim 2, wherein the silicon produced as a result of the exhausting does not substantially remain by forming a compound with at least one of magnesium in the magnesium alloy and other alloy elements.

6. The method of claim 2, wherein the silicon compound is in a powder phase to promote a reaction between the silicon compound with the magnesium or magnesium alloy.

7. The method of claim 2, wherein the silicon compound is added to the molten magnesium or magnesium alloy in an amount enough to fully react with the molten magnesium or magnesium alloy to be completely exhausted such that the silicon compound does not substantially remain in the magnesium alloy.

8. The method of claim 4, wherein the agitating is performed by electromagnetically agitating the molten magnesium or magnesium alloy.

9. The method of claim 4, wherein the agitating is performed by mechanically agitating the molten magnesium or magnesium alloy.

10. The method of claim 4, wherein the agitating is performed in a state in which a surface of the molten magnesium or magnesium alloy is exposed in the air.

11. The method of claim 5, wherein the produced compound is $Mg_2Si$.

12. The method of claim 6, wherein the silicon compound has a grain size in a range of 0.1 to 200 μm.

13. The method of claim 7, wherein the silicon compound is added in an amount of 0.001 wt % to 30 wt %.

14. A method for producing a magnesium-based alloy, the method comprising:

melting a magnesium or magnesium alloy into a liquid phase;

adding a silicon compound to the molten magnesium or magnesium alloy;

evenly spreading the added silicon compound on the molten magnesium or magnesium alloy such that the added silicon compound is not mixed into the molten magnesium or magnesium alloy;

removing oxygen elements from the silicon compound through a reduction reaction between the molten magnesium or magnesium alloy and the added silicon compound; and making the silicon produced as a result of the reduction reaction into a compound in the molten magnesium or magnesium alloy.

15. The method of claim 14, wherein the oxygen elements are removed in the form of oxygen gas or in the form of dross through a combination of magnesium elements in the molten magnesium or magnesium alloy and/or magnesium alloy elements.

16. The method of claim 14, wherein the silicon produced as a result of the reduction reaction does not substantially remain by forming a compound with at least one of magnesium in the magnesium alloy and other alloy elements.

17. The method of claim 14, wherein the silicon compound is in a powder phase to promote a reaction between the silicon compound with the magnesium or magnesium alloy.

18. The method of claim 14, wherein the silicon compound is added to the molten magnesium or magnesium alloy in an amount enough to fully react with the molten magnesium or magnesium alloy to be completely exhausted such that the silicon compound does not substantially remain in the magnesium alloy.

19. The method of claim 16, wherein the compound of the silicon produced as a result of the reduction reaction and the magnesium or magnesium alloy is $Mg_2Si$.

20. The method of claim 17, wherein the silicon compound has a grain size in a range of 0.1 to 200 μm.

21. The method of claim 18, wherein the silicon compound is added in an amount of 0.001 wt % to 30 wt %.

* * * * *